US009071897B1

(12) United States Patent
Johnston

(10) Patent No.: US 9,071,897 B1
(45) Date of Patent: Jun. 30, 2015

(54) MAGNETIC COUPLING FOR STEREO LOUDSPEAKER SYSTEMS

(71) Applicant: Robert G. Johnston, Arnprior (CA)

(72) Inventor: Robert G. Johnston, Arnprior (CA)

( * ) Notice: Subject to any disclaimer, the term of this patent is extended or adjusted under 35 U.S.C. 154(b) by 154 days.

(21) Appl. No.: 14/056,911

(22) Filed: Oct. 17, 2013

(51) Int. Cl.
*H04R 5/02* (2006.01)

(52) U.S. Cl.
CPC ..... *H04R 5/02* (2013.01)

(58) Field of Classification Search
CPC ..... H04R 5/02; H04R 3/12; H04R 5/04; H04R 2499/15; H04R 1/403; H04R 27/00
USPC ..... 381/300
See application file for complete search history.

(56) References Cited

U.S. PATENT DOCUMENTS

| | | | | |
|---|---|---|---|---|
| 3,657,480 | A | 4/1972 | Cheng et al. | |
| 4,315,102 | A | 2/1982 | Eberbach | |
| 4,350,847 | A | 9/1982 | Polk | |
| 4,413,162 | A | 11/1983 | Lumsden et al. | |
| 4,489,432 | A | 12/1984 | Polk | |
| 4,497,064 | A | 1/1985 | Polk | |
| 4,569,074 | A | 2/1986 | Polk | |
| 4,593,405 | A | 6/1986 | Frye et al. | |
| 4,597,100 | A | 6/1986 | Grodinsky et al. | |
| 4,638,505 | A | 1/1987 | Polk | |
| 7,231,053 | B2 | 6/2007 | Polk, Jr. | |
| 7,817,812 | B2 | 10/2010 | Polk, Jr. et al. | |
| 8,194,874 | B2 | 6/2012 | Starobin et al. | |
| 8,265,310 | B2 * | 9/2012 | Berardi et al. | 381/300 |
| 8,687,829 | B2 * | 4/2014 | Hilpert et al. | 381/300 |
| 2010/0316237 | A1 * | 12/2010 | Elberbaum | 381/300 |
| 2014/0219480 | A1 * | 8/2014 | Collins | 381/300 |

OTHER PUBLICATIONS

Glotfelty; Polk Audio, P0132003; SDA 2B/CRS+ Schematic NC; http://www.polkaudio.com/forums/showthread.php?55888-Polk-Audio-Speaker-Wiring-Schematics-amp-More-Stereo-Dimensional-Arrar/%28SDA%29; drawing is dated Oct. 26, 1987.

* cited by examiner

*Primary Examiner* — Mark Blouin
(74) *Attorney, Agent, or Firm* — Robert J. Harter

(57) ABSTRACT

A stereo loudspeaker system with a right channel and a left channel respectively feeding R and L signals to four speakers (including a right main speaker, a right sub-speaker, a left main speaker and a left sub-speaker) includes a transformer that, depending on the frequency, magnetically couples or isolates the two channels at the right and left sub-speakers. At low frequencies, the transformer isolates the right channel from the left one so that the R signal goes primarily only to the two right speakers, and the L signal goes primarily only to the two left ones. At high frequencies, both the right and left main speakers still receive their respective R and L signals; however, the transformer's magnet coupling conveys a differential R-L signal to the right sub-speaker and a differential L-R signal to the left sub-speaker, thereby producing an expanded acoustic image and realistic ambient field.

20 Claims, 7 Drawing Sheets

MAGNETIC COUPLING FOR STEREO LOUDSPEAKER SYSTEMS

FIELD OF THE DISCLOSURE

The present disclosure relates generally to loudspeaker systems and more specifically to stereo systems with two channels each having main and sub speakers.

BACKGROUND

Some stereo loudspeaker systems have right and left channels driving four speakers, wherein the four speakers include a pair of speakers on the right and another pair on the left. Each pair comprises a main speaker and an associated sub-speaker, so the system includes a right main speaker, a right sub-speaker, a left main speaker and a left sub-speaker. Examples of such systems are disclosed in U.S. Pat. Nos. 4,489,432 and 4,638,505, both of which are specifically incorporated herein by reference.

In some cases, the right and left channels feed R and L signals to the right and left main speakers, respectively. In addition, at lower frequencies, R and L signals are applied respectively to the right and left sub-speakers as well. At certain higher frequencies, however, a differential R-L signal is sent to the right sub-speaker, and a differential L-R signal is sent to the left sub-speaker. Although the proposed benefits of this are well known to those of ordinary skill in the art, actually achieving the desired results has been an elusive goal due to an assortment of problems pertaining to some frequencies, various signal conditions and/or certain amplifiers.

Various attempts to avoid some problems seem to create others. The '505 patent, for instance, discloses using a combination of capacitors and inductors for providing a desired response at both high and low frequencies; however, resonance and distortion seem to occur at a transitional point between high and low frequencies. In what perhaps is an attempt to avoid resonance created by a combination of capacitors and inductors, some known systems omit the capacitors of the '505 patent, add a crossover wire between the two sub-speakers, and rearrange the circuit such that two inductors, without the capacitors of the '505 patent, provide desired responses at both high and low frequencies. A prior art Polk Audio electrical schematic SDA 2B/CRS+ Schematic NC refers to such a crossover wire as an "IC wire from the crossover." A crossover wire connecting two sub-speakers, however, can provide a low DC impedance connection between the right and left minus input terminals of the amplifier, which can create problems with certain amplifiers, particularly amplifiers of the bridge type output.

Other known prior art systems insert a capacitor along the shunt to break the shunt's otherwise low DC impedance path. Adding the capacitor, unfortunately, reintroduces the resonance issue as an undesirable artifact. Over certain frequencies (e.g., 50-200 Hz) and/or under certain conditions (e.g., when L=−R, or when L exists while R=0), the capacitor resonates with the series inductors, resulting in sudden shifts in phase and level changes in the sub-speakers. In some cases, the resonance of the added capacitor with the series inductors produces poor transient response in the 50-200 Hz range. The sudden shift in phase, level and poor transient response produce undesirable audible effects, such as objectionable coloration in the upper bass and lower midrange frequencies.

DETAILED DESCRIPTION

Figure 1:
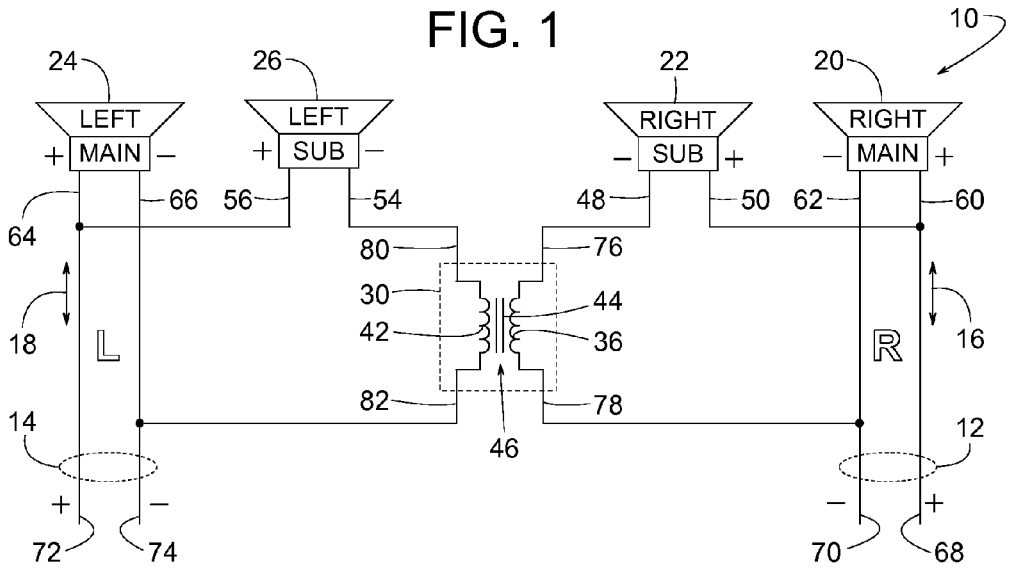
FIG. 1 is an electrical schematic of an example loudspeaker system in accordance with the teachings disclosed herein.
Figure 2:
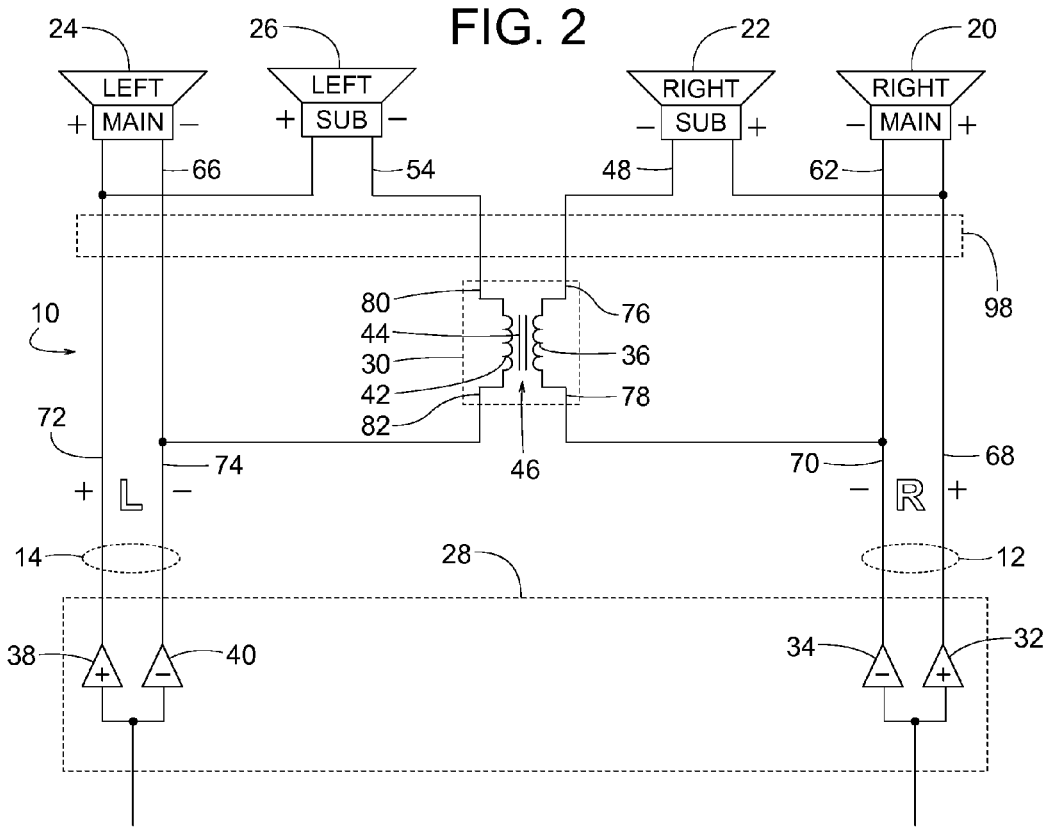
FIG. 2 is an electrical schematic similar to FIG. 1 but showing the addition of an example bridge style amplifier system.
Figure 3:
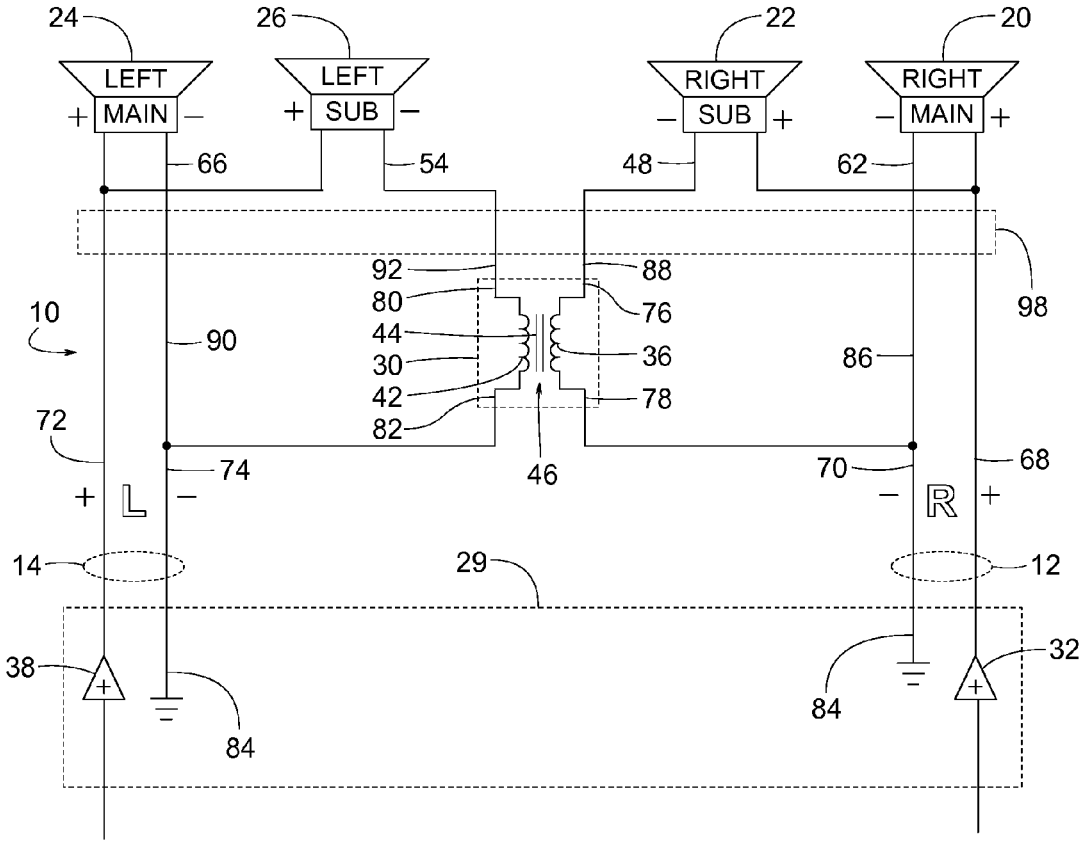
FIG. 3 is an electrical schematic similar to FIG. 1 but showing the addition of an example non-bridge style amplifier system.
Figure 4:
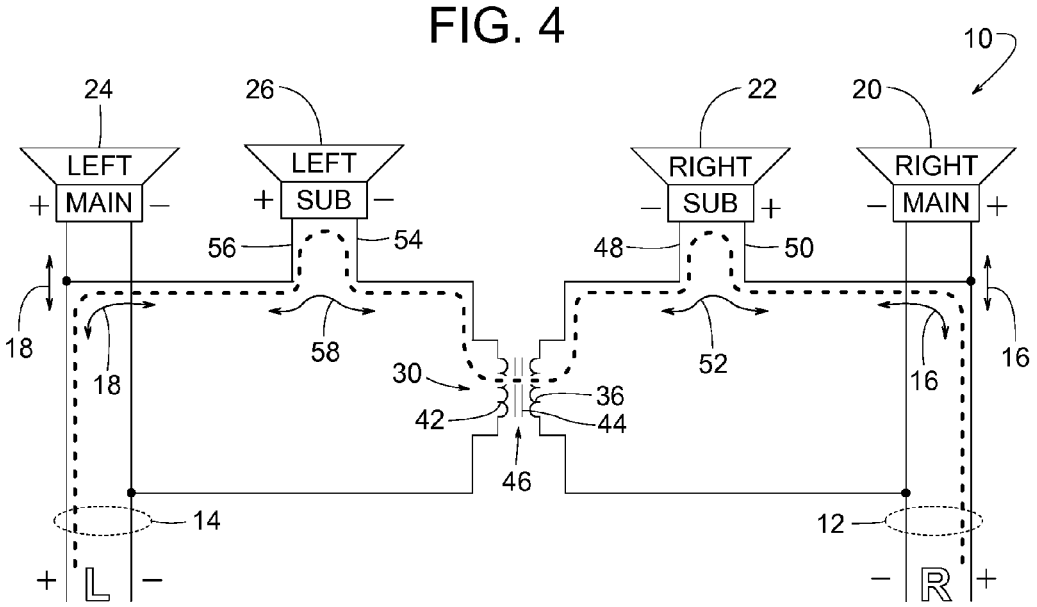
FIG. 4 is an electrical schematic similar to FIG. 1 but showing the system operating in a high frequency mode.
Figure 5:
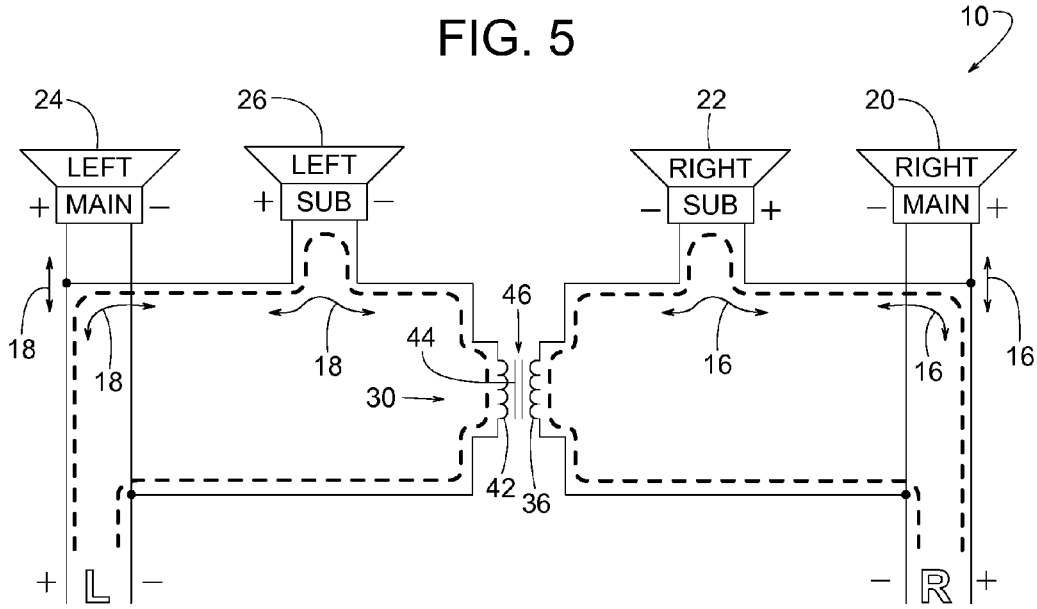
FIG. 5 is an electrical schematic similar to FIG. 4 but showing the system operating in a low frequency mode.
Figure 6:
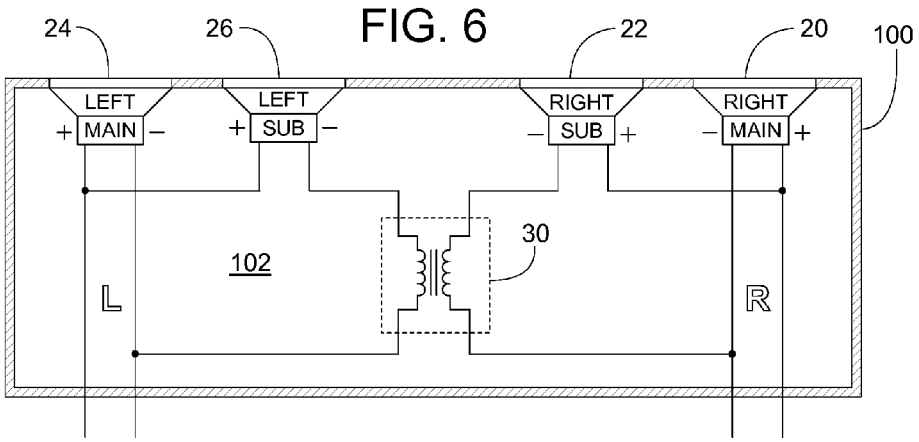
FIG. 6 is a schematic diagram showing the loudspeaker system of FIG. 1 installed within an example enclosure.
Figure 7:
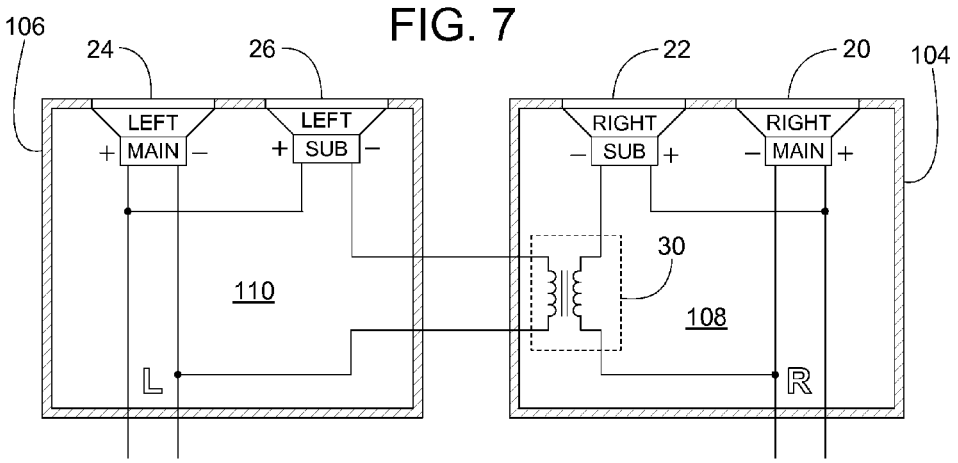
FIG. 7 is a schematic diagram similar to FIG. 6 but showing the loudspeaker system installed within an alternate enclosure arrangement.
Figure 8:
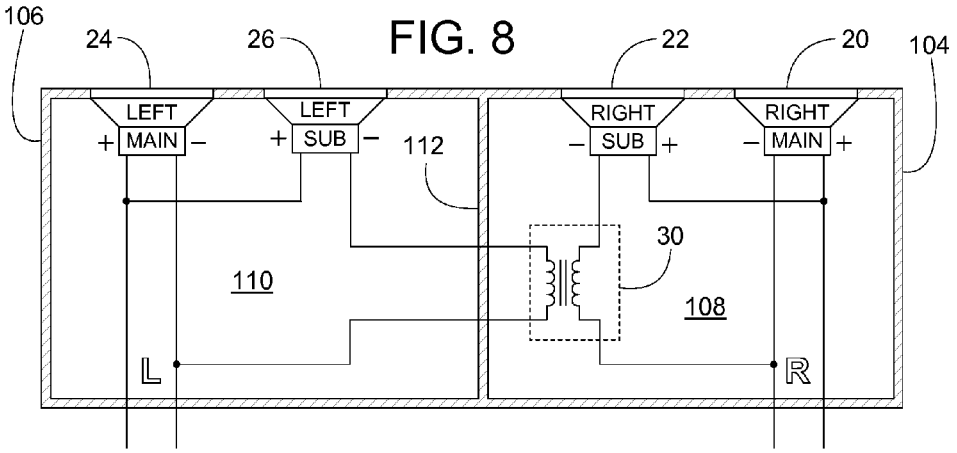
FIG. 8 is a schematic diagram similar to FIGS. 6 and 7 but showing yet another example enclosure arrangement.

FIGS. 1-8 illustrate an example stereo loudspeaker system 10 having a right channel 12 and a left channel 14 that deliver an audio signal R 16 and an audio signal L 18 to right and left sets of speakers. In some examples, the right set of speakers includes a right main speaker 20 and a right sub-speaker 22, and the left set of speakers includes a left main speaker 24 and a left sub-speaker 26. FIG. 1 shows a basic electrical schematic of one example of system 10, FIG. 2 shows system 10 including an example bridge style amplifier system 28, FIG. 3 shows system 10 including an example non-bridge style amplifier system 29, FIGS. 4 and 5 show example audio signal flow patterns at different frequencies, and FIGS. 6, 7 and 8 show examples where multiple speakers of system 10 share the same acoustic volume within various enclosures.

To achieve the benefits and overcome the limitations of the loudspeaker systems disclosed in U.S. Pat. Nos. 4,489,432 and 4,638,505, both of which are specifically incorporated herein by reference, loudspeaker system 10 includes a transformer 30 having a certain relationship with sub-speakers 22 and 26. Transformer 30 eliminates the need for a conventional crossover wire between the two sub-speakers 22 and 26, thus making system 10 compatible with a variety of amplifiers, including those with a bridge type output.

In the example shown in FIG. 2, amplifier system 10 has a right plus amp 32 connected to both the right main speaker 20 and right sub-speaker 22, a right minus amp 34 connected to both the right main speaker 20 and a first winding 36 of transformer 30, a left plus amp 38 connected to both the left main speaker 24 and left sub-speaker 26, and a left minus amp 40 connected to both the left main speaker 24 and a second winding 42 of transformer 30. To prevent a small random DC voltage from driving an unopposed and surprisingly high DC error current through a crossover wire between the left and right minus amps 34 and 40, the crossover wire is eliminated and instead a magnetic coupling 44 of transformer 30 provides a DC current break 46 that is effectively between the left and right minus amps 34 and 40.

Depending on the amplifier's output frequency of signal R 16 and/or signal L 18, the magnetic coupling 44 between the transformer's windings 36 and 42 either isolates or combines signal R 16 and signal L 18, as applied to right and left sub-speakers 22 and 26. In some examples, at low frequency (e.g., a predetermined range of frequencies below 200 Hz), right channel 12 primarily feeds audio signal R 16 to right main speaker 20 and to right sub-speaker 22, and left channel 14 primarily feeds audio signal L 18 to left main speaker 24 and to left sub-speaker 26. At high frequency (e.g., a predetermined range of frequencies above 200 Hz), right channel 12 and left channel 14 still feed signal R 16 and signal L 18 to their respective right and left main speakers 20 and 24; however, transformer 30 operating at higher frequency conveys signal R 16 and signal L 18 across magnetic coupling 44 between windings 36 and 42.

Consequently, at relatively high frequency, magnetic coupling 44 transmits signal L 18 from second winding 42 to first winding 36. First winding 36, in turn, applies signal L 18 (e.g., an attenuated portion thereof) to a right sub negative terminal 48 of right sub speaker 22 while signal R 16 is applied to a right sub positive terminal 50, thereby feeding right sub-speaker 22 a right differential signal 52 (i.e., signal R 16 minus signal L 18, also denoted as an R-L signal). Likewise, magnetic coupling 44 transmits signal R 16 (e.g., an attenuated portion thereof) from first winding 36 to second winding 42. Second winding 42 then applies signal R 16 to a left sub negative terminal 54 of left sub speaker 26 while signal L 18 is applied to a left sub positive terminal 56, thereby feeding left sub-speaker 26 a left differential signal 58 (i.e., signal L 18 minus signal R 16, also denoted as an L-R signal). The term, "terminal" refers to an electrically conductive point and not necessarily a connector, plug, socket or screw.

In addition to terminals 48, 50, 54 and 56; other electrical points of loudspeaker system 10 include right main speaker 20 having a right main positive terminal 60 and a right main negative terminal 62 connected to right channel 12, left main speaker 24 having a left main positive terminal 64 and a left main negative terminal 66 connected to left channel 14, a right plus input terminal 68 and a right minus input terminal 70 on right channel 12, a left plus input terminal 72 and a left minus input terminal 74 on left channel 14, and transformer 30 having a plurality of terminals. The transformer's plurality of terminals include first winding 36 having a first point 76 and a second point 78, and second winding 42 having a third point 80 and a fourth point 82.

In the example shown in FIG. 3, amps 34 and 40 are omitted for the non-bridge style amplifier 29. For signal stability, a ground 84 connects to right minus input terminal 70, right main negative terminal 62, second point 78, fourth point 82, left minus input terminal 74 and left main negative terminal 66 in a certain strategic arrangement. Such an arrangement creates a first electrical path 86 from right main negative terminal 62 to ground 84, a second electrical path 88 (via first winding 36) from right sub negative terminal 48 to ground 84, a third electrical path 90 from left main negative terminal 66 to ground 84, and a fourth electrical path 92 (via second winding 42) from left sub negative terminal 54 to the ground 84. This arrangement is believed to work particularly well when (a) first electrical path 86 is of lower impedance than second electrical path 88 at frequencies greater than 200 Hz, (b) third electrical path 90 is of lower impedance than fourth electrical path 92 at frequencies greater than 200 Hz, (c) second electrical path 88 passes through the transformer's first winding 36, and (d) fourth electrical path 92 passes through the transformer's second winding 42.

In some examples, a frequency of 200 Hz defines the loudspeaker system's transition between its high-frequency mode (FIG. 4) and its low-frequency mode (FIG. 5). During the low frequency mode, as shown in FIG. 5, signal R 16 passes through both the right sub-speaker 22 and the transformer's first winding 36, and signal L 18 passes through both the left sub-speaker 26 and the transformer second winding 42. During the high frequency mode, as shown in FIG. 4, signal L 18 is applied to left sub-speaker 26, magnetically transferred from the transformer's second winding 42 to first winding 36, and is applied to right sub-speaker 22. At the same time, signal R 16 is applied to right sub-speaker 22, magnetically transferred from the transformer's first winding 36 to second winding 42, and is applied to left sub-speaker 26; whereby left differential signal 58 (L-R) is applied to left sub-speaker 26 and right differential signal 52 (R-L) is applied to right sub-speaker 22.

Although 200 Hz, in some examples, defines the loudspeaker system's transition between its high-frequency mode and its low-frequency mode, the transition point is approximate and does not necessarily occur abruptly nor precisely at 200 Hz. In some examples, as the frequency decreases toward 200 Hz, transformer 30 attenuates the −L portion of right differential signal 52 (R-L), as applied to right sub-speaker 22, and attenuates the −R portion of left differential signal 58 (L-R), as applied to left sub-speaker 26. At some predetermined frequency at or below 200 Hz, right differential signal 52 (R-L) becomes predominantly signal R 16, and left differential signal 58 (L-R) becomes predominantly signal L 18.

While some examples of system 10 have 200 Hz as the chosen defining transition frequency between the system's high and low frequency modes, other examples of system 10 have transition frequencies higher and lower than 200 Hz. In some examples, however, 200 Hz is chosen because only the frequency range between about 200 Hz and 1,000 Hz is used by a listener's directional hearing mechanism to determine the direction of a sound on the basis of inter-aural time delays, as taught in U.S. Pat. No. 4,638,505.

The relationship between the sub-speakers' impedance and the transformer winding inductance helps determine or establish the transition frequency of system 10. In some examples, for a transition frequency of about 200 Hz, each sub-speaker 22 and 26 has a nominal impedance of 8 ohms while each winding 36 and 42 of transformer 30 has a nominal impedance of about half that or about 4 ohms at 200 Hz. Other examples of system 10 vary from those values. For instance, in some examples, right sub-speaker 22 has a sub-speaker impedance at 200 Hz, first winding 36 of transformer 30 has a winding impedance at 200 Hz, and a ratio of the sub-speaker impedance to the winding impedance at 200 Hz is between 0.5 and 8.

Although it is possible to establish a 200 Hz transition frequency by means other than by using transformer 30, such alternate means may create various problems, such as resonance, distortion, audible artifacts, excess sub-speaker stress, abrupt phase shifts and incompatibility with certain amplifiers (particularly bridged type output amplifiers). Some of these problems may be more noticeable during certain operating condition, such as, for example, when R=−L, or when L is present while R=0, or when R is present while L=0. System 10 with transformer 30, however, mostly avoids these problems, as illustrated in FIGS. 9-14.

FIGS. 9-14 provide comparisons of a SPICE simulation circuit based on an example of system 10 (solid lines 94*a*-94*f*) with transformer 30 and a SPICE simulation circuit based on a conventional system without transformer 30 (dashed lines 96*a*-96*f*). The term, "SPICE," as known to those of ordinary skill in the art, is a Simulation Program with Integrated Circuit Emphases, which is a known general-purpose, open source electrical circuit simulator.

Figure 9:
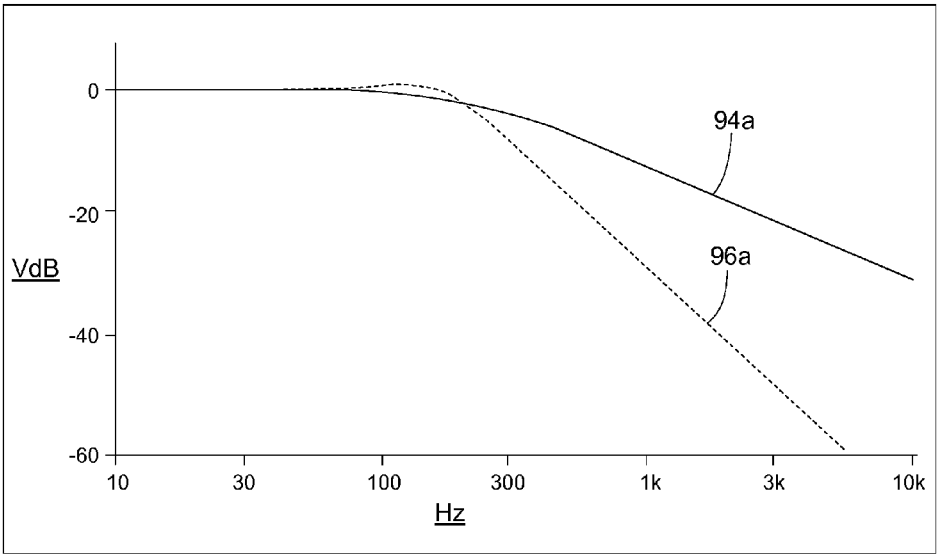
FIG. 9 is a graph showing a comparison of SPICE simulation results of anticipated amplitude responses of sub-speaker signals when signal R=L.
Figure 10:
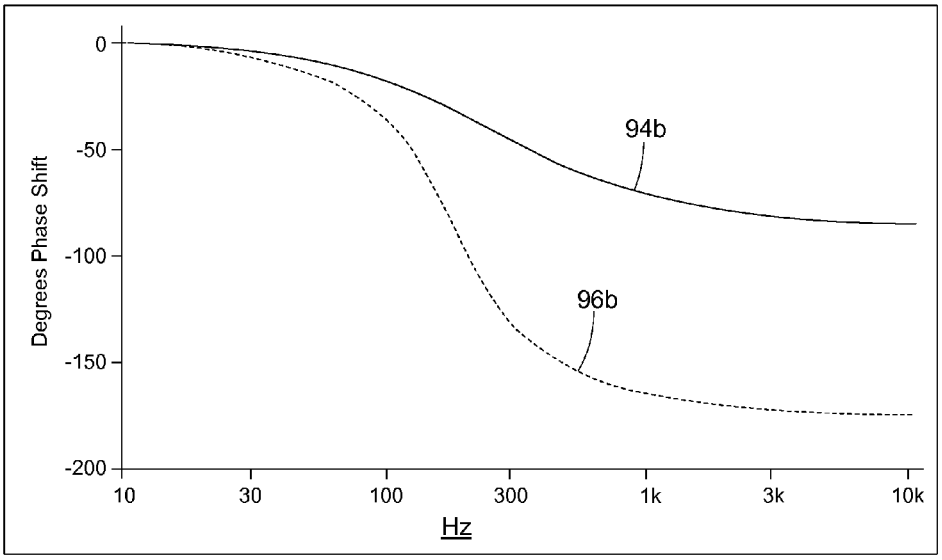
FIG. 10 is a graph showing a comparison of SPICE simulation results of anticipated phase responses of sub-speakers when signal R=L.
Figure 11:
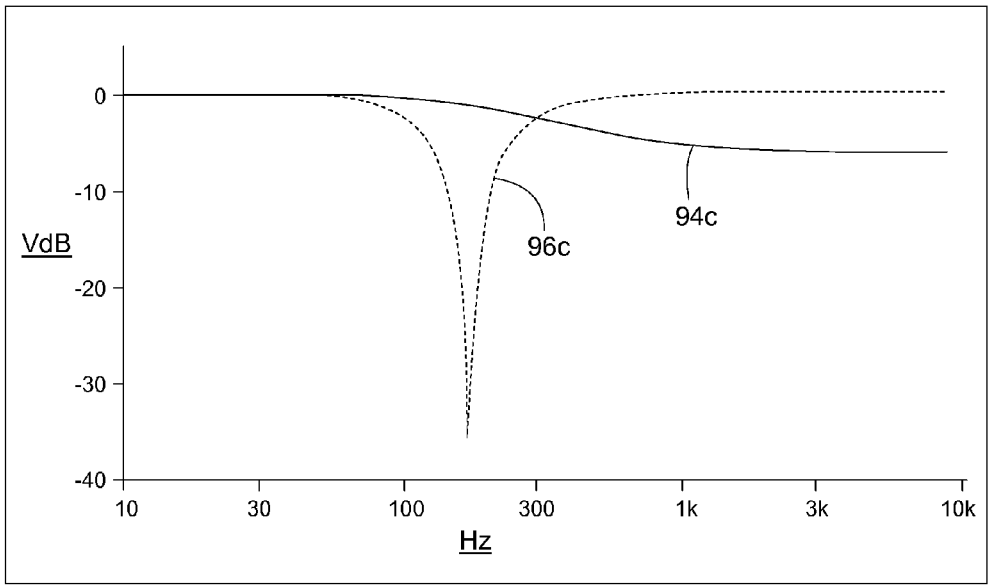
FIG. 11 is a graph showing a comparison of SPICE simulation results of anticipated amplitude responses of sub-speaker signals when only one channel R or L is active.
Figure 12:
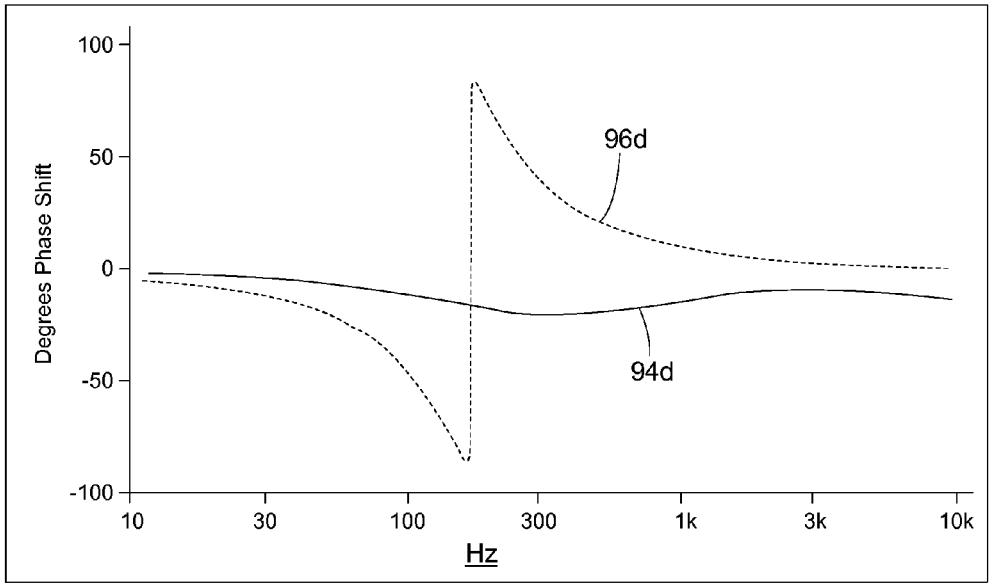
FIG. 12 is a graph showing a comparison of SPICE simulation results of anticipated phase responses of sub-speakers when only one channel R or L is active.
Figure 13:
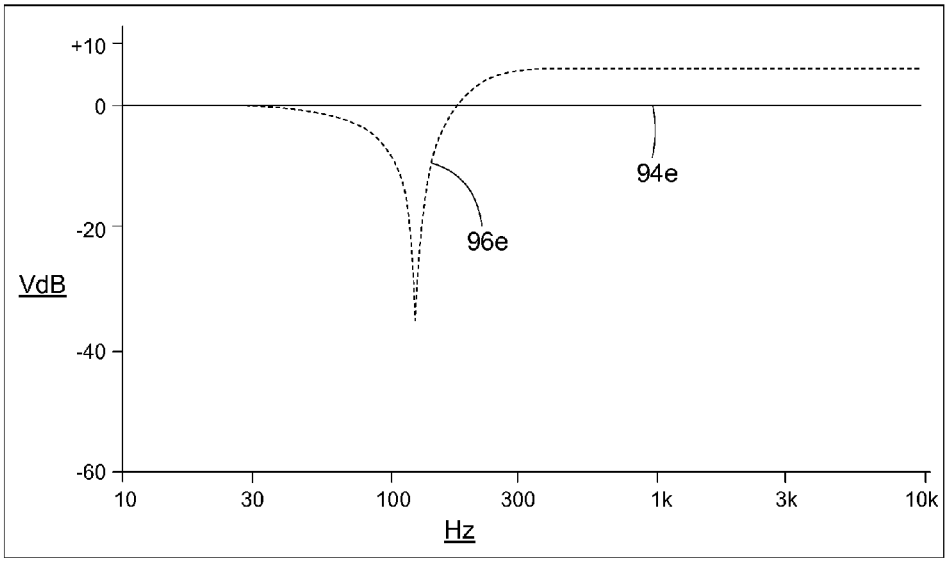
FIG. 13 is a graph showing a comparison of SPICE simulation results of anticipated amplitude responses of sub-speaker signals when signals R and L are opposite each other (e.g., R=1 while L=−1).
Figure 14:
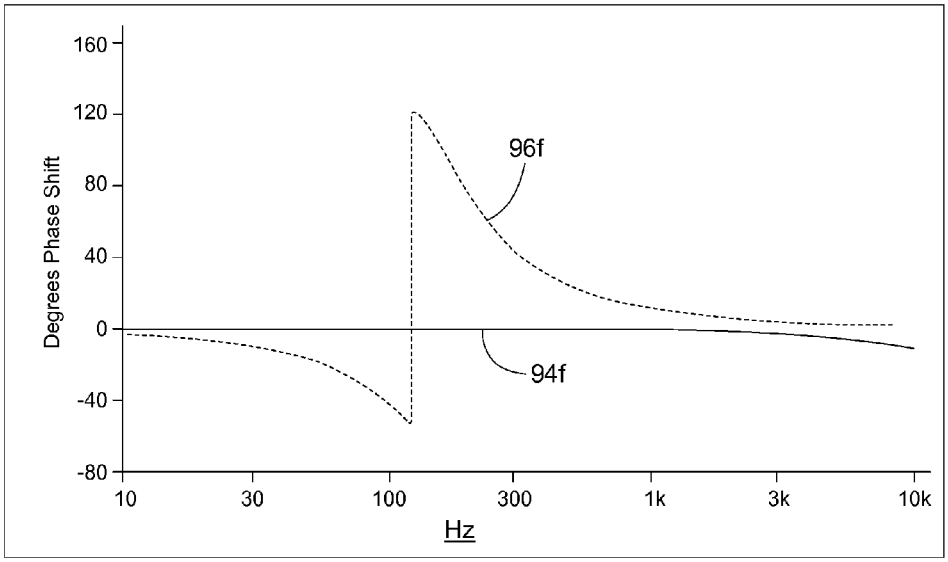
FIG. 14 is a graph showing a comparison of SPICE simulation results of anticipated phase responses of sub-speakers when signals R and L are opposite each other (e.g., R=1 while L=−1).

In FIGS. 9, 11 and 13; the vertical y-axis, or ordinate, shows voltage amplitude expressed in decibels. In FIGS. 10, 12 and 14; the vertical y-axis, or ordinate, shows phase shift expressed in degrees. In FIGS. 9-14, the horizontal x-axis, or abscissa, is a frequency scale in units of Hertz.

FIGS. 9 and 10 illustrate sub-speaker response when signal R 16 equals signal L 18 (i.e., R=L, mono). In FIG. 9, solid line 94*a* represents the amplitude response of left sub-speaker 26 of system 10 over a range of frequencies, and dashed line 96*a* represents the amplitude response of a conventional system (e.g., a system based on U.S. Pat. No. 4,638,505). In FIG. 10, solid line 94*b* represents the phase response of left sub-speaker 26 of system 10 over a range of frequencies, and dashed line 96*b* represents the phase response of a conventional system.

FIGS. 11 and 12 illustrate sub-speaker response when the loudspeaker system receives a signal from only the right or left channel. In the example of FIGS. 11 and 12, the loudspeaker system receives only signal L 18 while right channel 12 is basically at ground. In FIG. 11, solid line 94*c* represents the amplitude response of left sub-speaker 26 of system 10 over a range of frequencies, and dashed line 96*c* represents the amplitude response of a conventional system. In FIG. 12, solid line 94*d* represents the phase response of left sub-speaker 26 of system 10 over a range of frequencies, and dashed line 96*d* represents the phase response of a conventional system.

FIGS. 13 and 14 illustrate sub-speaker response when signal R 16 is opposite in amplitude to signal L 18 (i.e., R=−L). In FIG. 13, solid line 94*e* represents the amplitude response of left sub-speaker 26 of system 10 over a range of frequencies, and dashed line 96*e* represents the amplitude response of a conventional system. In FIG. 14, solid line 94*f* represents the phase response of left sub-speaker 26 of system 10 over a range of frequencies, and dashed line 96*f* represents the phase response of a conventional system.

At midrange frequencies, the loading presented by an acoustic volume usually does not significantly influence the response of an enclosed speaker. At low frequencies, however, the response of a speaker is controlled to a great extent by the ratio of the speaker's total diaphragm area to acoustic volume. In cases where two or more speakers operate within the same acoustic volume, the ratio of the speakers' total diaphragm area to acoustic volume will change accordingly (e.g., change by a factor of two where two identical speakers share a common enclosure). An excessively high diaphragm/volume ratio can create adverse loading, depending on the relationship of the right and left channel signals. So, under certain conditions, it is difficult or impossible for a frequency tailoring circuit to tune some stereo loudspeaker systems for optimum low frequency response.

With transformer 30, however, sub-speakers 22 and 26 can operate in a consistent manner at low frequencies regardless of the relationship of channel signal R 16 and signal L 18. Some examples of system 10 can thus be optimally tuned by way of a known frequency tailoring circuit 98 (FIGS. 2 and 3) without the need for compromise necessitated by a main speaker and its associated sub-speaker operating and interacting within the same acoustic volume. Consequently, transformer 30 makes loudspeaker system 10 particularly suited for various enclosure configurations including, but not limited to, the examples shown in FIGS. 6, 7 and 8. The example of FIG. 6 shows speakers 20, 22, 24 and 26 plus transformer 30 installed within a single enclosure 100, whereby all four speakers 20, 22, 24 and 26 share a common acoustic volume 102 defined by enclosure 100. The example of FIG. 7 shows speakers 20 and 22 in one enclosure 104 and speakers 24 and 26 in another enclosure 106. So, right main speaker 20 and right sub-speaker 22 share a common acoustic volume 108 defined by enclosure 104, and left main speaker 24 and left sub-speaker 26 share a common acoustic volume 110 defined by enclosure 106. FIG. 8 basically shows an example where enclosures 104 and 106 share a common dividing wall 112. Although transformer 30 can be mounted inside or outside of any speaker enclosure, transformer 30 sharing an enclosure with multiple speakers 20, 22, 24 and/or 26 simplifies the construction of system 10, as shown in FIGS. 6, 7 and 8. In some examples, speakers 20, 22, 24 and 26 are contained separately within four individual enclosures.

The following provides additional clarification. The terms, "right" and "left" are nondescript labels used merely for distinguishing one item from another in the same way the labels, "first" and "second" would do, and so the terms, "right" and "left" do not necessarily determine an item's relative location to a listener or to another item. Thus, for example, saying that a right main speaker and a right sub-speaker share the same acoustic volume is equivalent to saying that a left main speaker and left sub-speaker share the same acoustic volume. The terms, "speaker" and "driver" are equivalent and used interchangeably. The terms, "amp" and "amplifier" are equivalent and used interchangeably. The term, "negative" as it relates to identifying various terminals is simply a distinguishing label and thus does not mean that the signal on such terminals are necessarily negative. A DC current interruption or break refers to a substantially non-electrically conductive path. The term, "frequency tailoring circuit" refers to any known circuit of capacitors, inductors, resistors and/or other electrical components for enhancing or correcting signals conveyed to a speaker. The term, "high frequency mode" simply means that the audio signal is at a predetermined high frequency range above a predetermined transitional frequency (e.g., above 200 Hz), and the term, "low frequency mode" simply means that the audio signal is at a predetermined low frequency range below the predetermined transitional frequency. The term, "effectively between" as it pertains to the magnet coupling relative to the windings of the transformer means that the magnetic coupling is situated to transmit a magnetic field from one winding to the other. The term, "effectively between" as it pertains a DC current break or interruption being effectively between two amps means that the DC current break or interruption is generally void of an electrically conductive DC path connecting one amp to the other. The term, "magnetic coupling" refers to structure being of a material and being at a position to transmit an appreciable magnetic field from one winding to another. Examples of materials for a magnet coupling include, but are not limited to, iron and alloys of iron.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

The invention claimed is:

1. A loudspeaker system having selectively a high frequency mode and a low frequency mode, wherein the high frequency mode is defined as being at a first predetermined range of frequencies above 200 Hz, and the low frequency mode is defined as being at a second predetermined range of frequencies below 200 Hz, the loudspeaker system comprising:

a right main speaker;

a right sub-speaker;

a left main speaker;

a left sub-speaker;

a transformer comprising a first winding, a second winding, and a magnetic coupling effectively between the first winding and the second winding;

a signal R applied to the right main speaker;

a signal L applied to the left main speaker;

a right differential signal comprising the signal R minus the signal L;

a left differential signal comprising the signal L minus the signal R;

the signal R applied to the right sub-speaker and conveyed by the first winding of the transformer when the loudspeaker system is in the low frequency mode;

the signal L applied to the left sub-speaker and conveyed by the second winding of the transformer when the loudspeaker system is in the low frequency mode;

the right differential signal applied to the right sub-speaker and transmitted by the magnetic coupling of the transformer when the loudspeaker system is in the high frequency mode; and the left differential signal applied to the left sub-speaker and transmitted by the magnetic coupling of the transformer when the loudspeaker system is in the high frequency mode.

2. The loudspeaker system of claim 1, further comprising an amplifier system that includes a right plus amp connected to both the right main speaker and the right sub-speaker, a right minus amp connected to both the right main speaker and the first winding of the transformer, a left plus amp connected to both the left main speaker and the left sub-speaker, and a left minus amp connected to both the left main speaker and the second winding of the transformer; the magnetic coupling of the transformer providing a DC current break effectively between the right minus amp and the left minus amp.

3. The loudspeaker system of claim 1, further comprising an enclosure defining a common acoustic volume of space shared by the right main speaker and the right sub-speaker.

4. The loudspeaker system of claim 1, further comprising an enclosure defining a common acoustic volume of space shared by the right main speaker, the left main speaker, the right sub-speaker and the left sub-speaker.

5. The loudspeaker system of claim 4, wherein the transformer is contained within the enclosure.

6. The loudspeaker system of claim 1, wherein the right sub-speaker has a sub-speaker impedance at 200 Hz, and the first winding of the transformer has a winding impedance at 200 Hz, and a ratio of the sub-speaker impedance to the winding impedance at 200 Hz is between 0.5 and 8.

7. A loudspeaker system comprising:

a right main speaker having a right main positive terminal and a right main negative terminal;

a right sub-speaker having a right sub positive terminal and right sub negative terminal;

a left main speaker having a left main positive terminal and a left main negative terminal;

a left sub-speaker having a left sub positive terminal and left sub negative terminal;

a right plus input terminal;

a right minus input terminal;

a left plus input terminal;

a left minus input terminal;

a transformer comprising a first winding; a second winding, a magnetic coupling effectively between the first winding and the second winding, and a plurality of terminals including a first point, a second point, a third point and a fourth point; the first winding being electrically connected to the first point and the second point; the second winding being electrically connected to the third point and the fourth point; and the loudspeaker system being configured such that a) the right plus input terminal connects to both the right main positive terminal and the right sub positive terminal, b) the right minus input terminal connects to both the right main negative terminal and the second point of the transformer, c) the left plus input terminal connects to both the left main positive terminal and the left sub positive terminal, d) the left minus input terminal connects to both the left main negative terminal and the fourth point of the transformer, e) the right sub negative terminal connects to the first point of the transformer, and f) the left sub negative terminal connects to the third point of the transformer.

8. The loudspeaker system of claim 7, wherein the loudspeaker system has selectively a high-frequency mode and a low-frequency mode, and the loudspeaker system further comprising:

a signal R passing through the right main speaker;

a signal L passing through the left main speaker;

a right differential signal comprising the signal R minus the signal L;

a left differential signal comprising the signal L minus the signal R;

during the low frequency mode, the signal R passing through both the right sub-speaker and the first winding of the transformer; and the signal L passing through both the left sub-speaker and the second winding of the transformer; and during the high frequency mode, the signal L being applied to the left sub-speaker, being magnetically transferred from the second winding to the first winding, and being applied to the right sub-speaker; and the signal R being applied to the right sub-speaker, being magnetically transferred from the first winding to the second winding, and being applied to the left sub-speaker; consequently, the right differential signal being applied to the right sub-speaker and the left differential signal being applied to the left sub-speaker.

9. The loudspeaker system of claim 8, wherein the high frequency mode is defined as being at a first predetermined range of frequencies above 200 Hz, and the low frequency mode is defined as being at a second predetermined range of frequencies below 200 Hz.

10. The loudspeaker system of claim 7, wherein the second point and the fourth point of the transformer are grounded.

11. The loudspeaker system of claim 7, further comprising an amplifier system that includes a right plus amp wired to the right plus input terminal, a right minus amp wired to the right minus input terminal, a left plus amp wired to the left plus input terminal, and a left minus amp wired to the left minus input terminal; the magnetic coupling of the transformer providing a DC current interruption effectively between the right minus amp and the left minus amp.

12. The loudspeaker system of claim 7, further comprising a frequency tailoring circuit coupling the right plus input terminal and the right minus input terminal to at least one of the right main speaker, the right sub-speaker and the transformer.

13. The loudspeaker system of claim 7, further comprising a frequency tailoring circuit coupling the left plus input terminal and the left minus input terminal to at least one of the left main speaker, the left sub-speaker and the transformer.

14. The loudspeaker system of claim 7, further comprising an enclosure defining a common acoustic volume of space shared by the right main speaker and the right sub-speaker.

15. The loudspeaker system of claim 7, further comprising an enclosure defining a common acoustic volume of space shared by the right main speaker, the left main speaker, the right sub-speaker and the left sub-speaker.

16. The loudspeaker system of claim 15, wherein the transformer is contained within the enclosure.

17. The loudspeaker system of claim 7, wherein the right sub-speaker has a sub-speaker impedance at 200 Hz, and the first winding of the transformer has a winding impedance at 200 Hz, and a ratio of the sub-speaker impedance to the winding impedance at 200 Hz is between 0.5 and 8.

18. A loudspeaker system operable in relation to a ground, the loudspeaker system comprising:

a right main speaker having a right main positive terminal and a right main negative terminal;

a right sub-speaker having a right sub positive terminal and right sub negative terminal;

a left main speaker having a left main positive terminal and a left main negative terminal;

a left sub-speaker having a left sub positive terminal and left sub negative terminal;

a transformer comprising a first winding, a second winding, and a magnetic coupling effectively between the first winding and the second winding;

a first electrical path from the right main negative terminal to the ground;

a second electrical path from the right sub negative terminal to the ground;

a third electrical path from the left main negative terminal to the ground; and a fourth electrical path from the left sub negative terminal to the ground, the first electrical path being of lower impedance than the second electrical path at frequencies greater than 200 Hz, the third electrical path being of lower impedance than the fourth electrical path at frequencies greater than 200 Hz, the second electrical path passing through the first winding of the transformer, and the fourth electrical path passing through the second winding of the transformer.

19. The loudspeaker system of claim 18, further comprising an amplifier system that includes a right plus amp connected to both the right main speaker and the right sub-speaker, a right minus input terminal connected to both the right main speaker and the first winding of the transformer, a left plus amp connected to both the left main speaker and the left sub-speaker, and a left minus input terminal connected to both the left main speaker and the second winding of the transformer; the magnetic coupling of the transformer providing a DC current break effectively between the right minus input terminal and the left minus input terminal.

20. The loudspeaker system of claim 18, wherein the right sub-speaker has a sub-speaker impedance at 200 Hz, and the first winding of the transformer has a winding impedance at 200 Hz, and a ratio of the sub-speaker impedance to the winding impedance at 200 Hz is between 0.5 and 8.

* * * * *